US006257441B1

(12) United States Patent
Maley

(10) Patent No.: US 6,257,441 B1
(45) Date of Patent: Jul. 10, 2001

(54) CHILD SAFE BUCKET AND LID

(76) Inventor: Frank M. Maley, 4809 Boston Ave., Trevose, PA (US) 19053

( * ) Notice: Subject to any disclaimer, the term of this patent is extended or adjusted under 35 U.S.C. 154(b) by 786 days.

(21) Appl. No.: 08/511,257

(22) Filed: Aug. 4, 1995

(51) Int. Cl.[7] ..... B65D 25/00; B65D 45/16

(52) U.S. Cl. ..... 220/840; 220/212; 220/326; 220/731; 220/735

(58) Field of Search ..... 220/315, 700, 220/731, 730, 735, 712, 713, 212, 570, 695, 696, 697, 840, 810, 326; 15/106, 146, 177.1, 147.2, 148, 248.1, 269

(56) References Cited

U.S. PATENT DOCUMENTS

| | | | | |
|---|---|---|---|---|
| 30,159 | | 9/1860 | Schmidt | 15/263 |
| 127,034 | * | 5/1872 | Drummond | 220/315 |
| 817,312 | * | 4/1906 | Gaddum | 220/315 |
| 887,704 | | 5/1908 | Shoemaker | 15/263 |
| 1,121,261 | * | 12/1914 | Lawrence | 220/731 X |
| 1,192,135 | * | 7/1916 | Stone | 220/315 X |
| 1,242,378 | * | 10/1917 | Shepard | 220/731 X |
| 2,149,255 | | 3/1939 | Fader | 15/260 |
| 2,533,354 | * | 12/1950 | Comfort | 220/697 |
| 2,665,029 | * | 1/1954 | Horrocks | 220/695 |
| 3,980,213 | * | 9/1976 | Ramsay | 220/700 X |
| 4,288,000 | | 9/1981 | Luker et al. | 220/281 |
| 4,298,132 | | 11/1981 | Galer | 220/288 |
| 4,328,904 | * | 5/1982 | Iverson | 220/315 X |
| 4,525,892 | | 7/1985 | Vayas et al. | 15/263 |
| 4,736,867 | * | 4/1988 | Feimer et al. | 220/337 |
| 4,741,450 | * | 5/1988 | Braude | 220/712 |
| 4,809,874 | * | 3/1989 | Pehr | 220/337 X |
| 4,995,526 | | 2/1991 | Garrison | 220/94 |
| 5,299,706 | | 4/1994 | Wardell, Jr. | 220/266 |

FOREIGN PATENT DOCUMENTS

| | | | | |
|---|---|---|---|---|
| 0975037 | * | 2/1951 | (FR) | 220/700 |

* cited by examiner

*Primary Examiner*—Allan N. Shoap
*Assistant Examiner*—Niki M. Eloshway
(74) *Attorney, Agent, or Firm*—LaMorte & Associates

(57) ABSTRACT

A child safe mop bucket assembly that prevents a child from accessing the contents of the bucket yet enables a mop to extend out of the bucket. The bucket assembly includes a fluid impermeable container having an open end and a lid element sized to cover that open end. The lid element contains an opening that enables a mop handle to extend out through the lid element if a mop is left within the container. The lid element also includes at least one locking pawl that engages the container when the lid element is closed over the open end of the container. The locking pawl is configured to be easily opened by an adult, yet cannot be opened by a small child. As a result, the lid element prevents a small child from accessing the contents of the bucket assembly even when a mop is left within the bucket assembly, thereby protecting the child from harm and the risk of drowning.

10 Claims, 4 Drawing Sheets

CHILD SAFE BUCKET AND LID

BACKGROUND OF THE INVENTION

1. Field of the Invention

The present invention relates to household buckets and pails that are designed to prevent a small child from falling into the bucket or accessing the liquids contained within the bucket. More particularly, the present invention relates to buckets with lids, wherein the lid permits a mop to be retained within the bucket while still preventing a child from accessing the contents of the bucket.

2. Statement of the Prior Art

Each year many children die as a result of falling into a simple mop bucket. A bucket filled with water is a tempting sight for a small child. However, if that child were to lean forward and fall into the bucket, the child could drown in only a few inches of water at the bottom of the bucket. Many other injuries are also associated with common mop buckets. Mop buckets often contain hot water that can burn the sensitive skin of a small child. Similarly, mop water often contains ammonia, detergents, bleach, phosphates and similar compounds that can cause severe injury if ingested by a child or splashed into the eyes of a child.

Over the years there have been many different containers that have been provided with some type of child protection cap. Childproof caps are commonly placed on most bottles of medicine, detergents, and other dangerous compounds. However, most of these childproof caps have compressible sides or alignment tabs that depend upon the superior strength and/or intelligence of an adult to open. Such child safety caps are most commonly used to cover small openings, such as bottle necks, wherein the safety cap can be easily manipulated and removed with one hand. Such child proofing technologies are not practical for large containers such as buckets, where the diameter of the opening may be over one foot. Due to the size of a bucket, lids that must be physically aligned, compressed or otherwise physically manipulated would require a considerable amount of physical effort, thereby making such applications very impractical.

There are many products sold in buckets, pails and small drums that have safety lids. However, many such containers have lids that require tools to be removed and reapplied. For example, a bucket of paint has a lid that requires a screw driver to be removed. Although such a lid is obviously childproof, it is entirely inappropriate for a mop bucket that must be opened and closed every few minutes. The prior art is also replete with buckets that have safety seals thereon. See for example U.S. Pat. No. 4,298,132 to Galer, entitled CHILD-PROOF LID AND PAIL ARRANGEMENT. Such buckets are only child safe until the bucket is opened for the first time and the safety seals are removed. Again, such a configuration is not applicable to a common mop bucket where the bucket is constantly being opened and resealed.

Bucket-like containers have been developed with covers that can be easily opened and closed. Such prior art containers are exemplified by U.S. Pat. No. 4,288,000 to Luker et al., entitled CHILD-RESISTANT LID FOR A PAIL. However, such containers either have lids that are very difficult to remove or approach the problem of child safety by providing only a small opening for accessing the contents of the bucket. Although providing a small access opening does prevent a small child from falling into the bucket, it does not prevent a child from reaching into the bucket. Furthermore, a small access opening precludes the placement of a mop head into the bucket, thereby making such a child safety feature very impractical for use with mop buckets.

It is therefore an object of the present invention to provide a low cost child safety bucket that can be easily opened and closed by an adult, yet isolates the contents of the bucket from a child.

It is a further object of the present invention to provide a child safe bucket that isolates the contents of a mop bucket even when a mop is extending from the bucket.

SUMMARY OF THE INVENTION

The present invention is a child safe mop bucket assembly that prevents a child from accessing the contents of the bucket yet enables a mop to extend out of the bucket. The bucket assembly includes a fluid impermeable container having an open end and a lid element sized to cover that open end. The lid element contains an opening that enables a mop handle to extend out through the lid element if a mop is left within the container. The lid element also includes at least one locking pawl that engages the container when the lid element is closed over the open end of the container. The locking pawl is configured to be easily opened by an adult, yet can not be opened by a small child. As a result, the lid element prevents a small child from accessing the contents of the bucket assembly even when a mop is left within the bucket assembly, thereby protecting the child from harm and the risk of drowning.

In an alternate embodiment, the lid element may have an opening that is large enough to pass a mop head therethrough, yet is oriented and sized so that a child cannot fall into the aperture. As a result, a person can continuously rinse the mop without opening the lid element, thereby protecting an unsupervised child from harm.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention can be used in many different applications where a container is used to hold liquids, such as a paint can, a tar bucket or the like, the present invention is especially suitable for use as a mop bucket. Accordingly, the present invention will be described in connection with two different configurations of a mop bucket in order to set forth the best mode contemplated for the invention.

Figure 1:
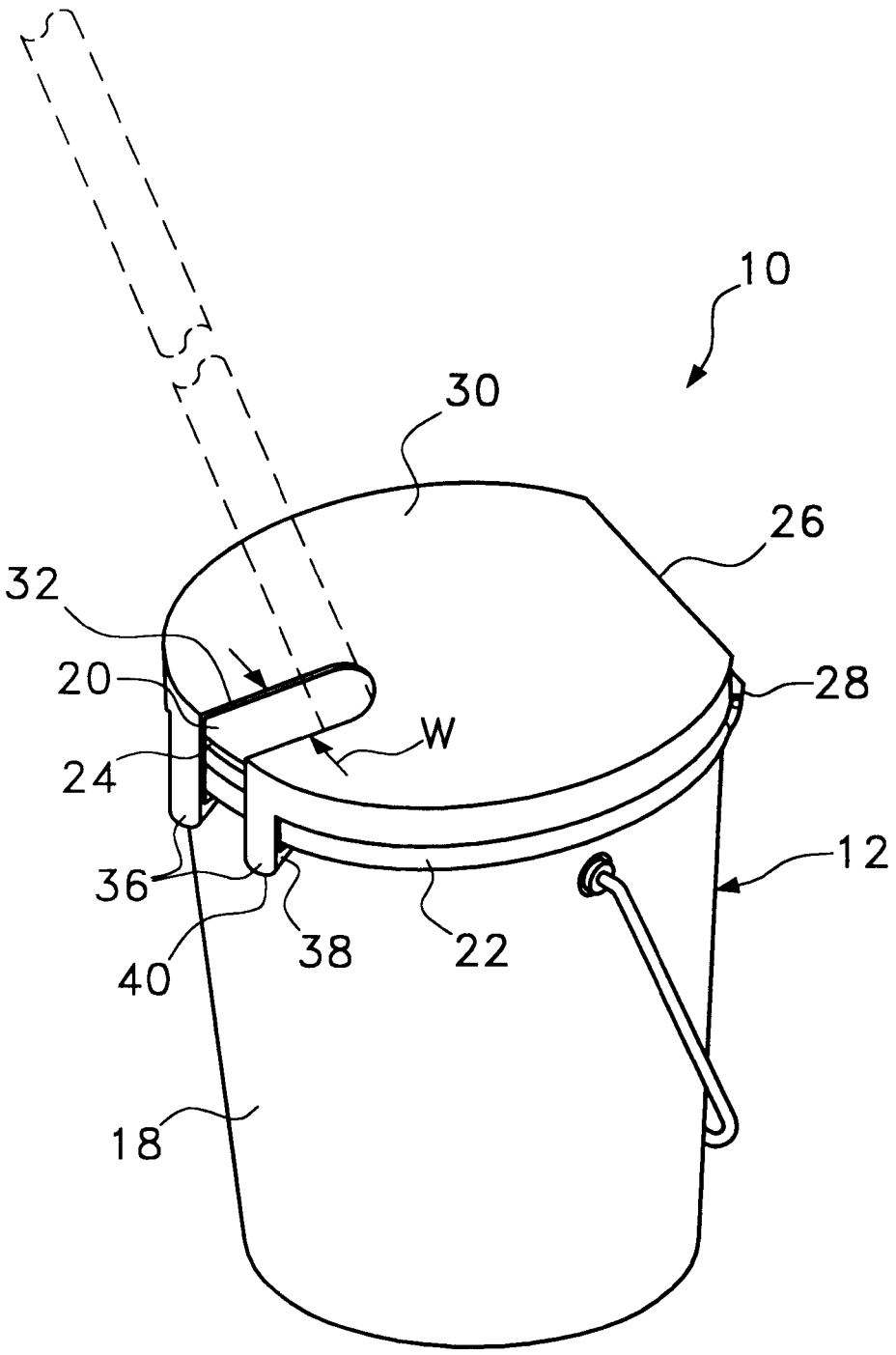
FIG. 1 is a perspective view of one preferred embodiment of the present invention bucket assembly, shown in conjunction with a mop to facilitate consideration and discussion.
Figure 2:
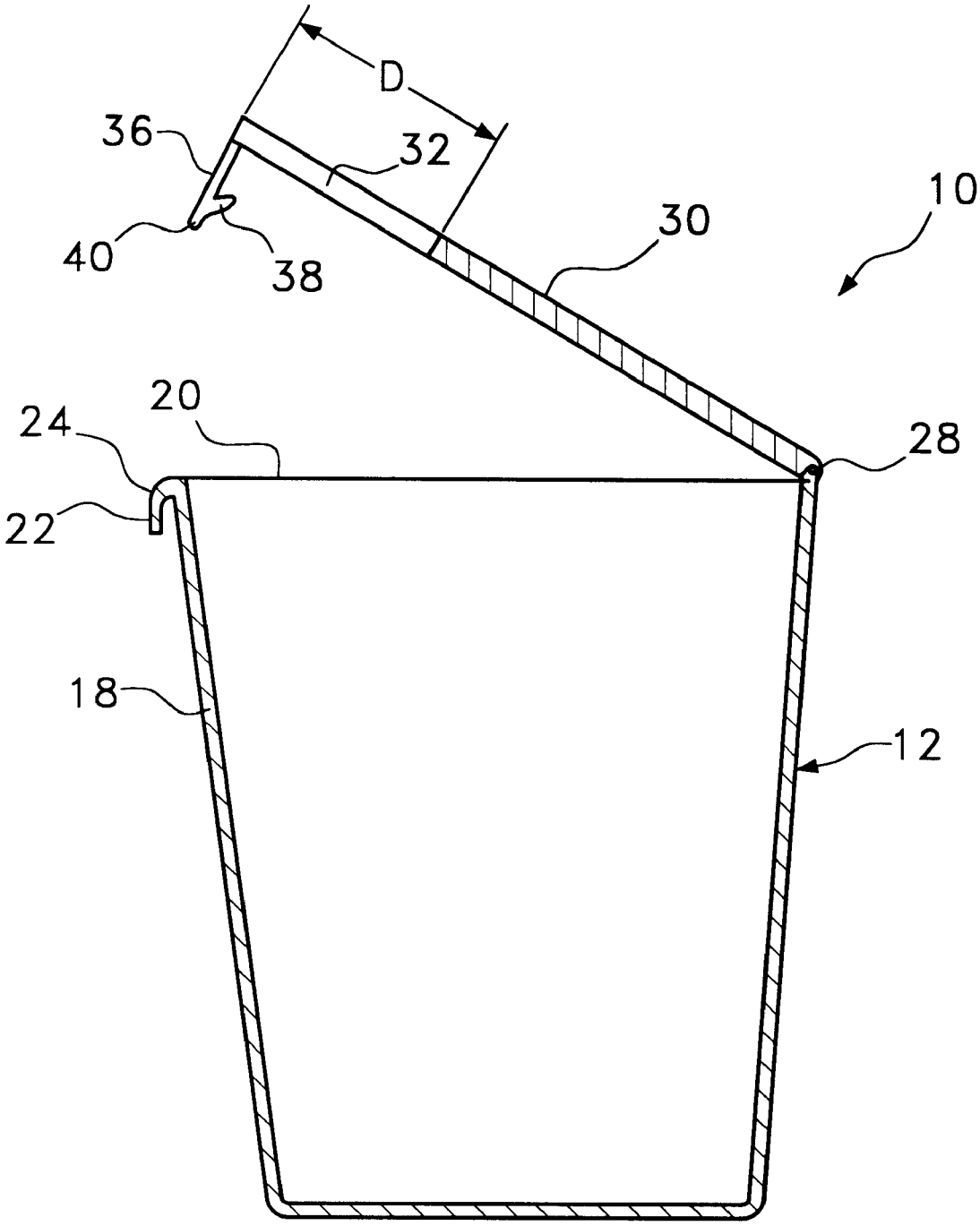
FIG. 2 is a cross-sectional view of the preferred embodiment of the present invention bucket assembly with its lid partially open to show features contained thereon.

Referring to FIG. 1 and FIG. 2, a first preferred embodiment of the present invention bucket assembly 10 is shown. The bucket assembly 10 is comprised of a bucket container 12 and a child safe lid 30. The bucket container 12 is a hollow cylindrical or frustrum shaped structure that is fluid impermeable and is preferably made of metal or plastic. Although the volume of the bucket container 12 could be any value, the bucket container 12 preferably has a volume of between three gallons and six gallons. In the shown embodiment, vertical wall 18 that defines the sides of the bucket container 12, flares outwardly at the top open end 20 of the bucket container 12. The flared section 22 is curved downwardly so as to provide the bucket container with a smooth curved rim 24.

From FIG. 1, it can be seen that the bucket container 12 has one flat section 26, formed as part of the vertical wall 18. In the preferred embodiment, the flat section 26 is provided to enable a straight hinge element 28 to be coupled to the rim 24 of the bucket container 12. The straight hinge element 28 pivotally connects bucket container 12 to a lid member 30. The hinge element 28 can be any type of hinge element known and used in the prior art, such as an elevator hinge, pintle hinge, tape hinge or the like and need not be limited to the double leaf hinge shown. Similarly, the construction of the hinge element 28 is dependent upon the materials selected for the bucket container 12 and lid member 30. For example, in the preferred embodiment, the bucket container 12 and lid member 30 are molded from plastic whereby the hinge element 28 can be molded as part of the bucket container 12 and lid member 30 so that the hinge functions when the bucket container 12 and lid member 30 are snap fit together.

The lid member 30 is shaped to cover the top open end 20 of the bucket container 12. A slot 32 is formed in the lid member 30. The slot 32 extends from a point on the circumference of the bucket container 12, opposite the hinge element 28, a predetermined distance D (FIG. 2) toward the center of the lid member 30. The distance D is preferably between two inches and five inches. The slot 32 also has a width W (FIG. 1) of between one and two inches so that the slot 32 can accommodate the diameter of most mop handles. In the shown embodiment, two locking pawls 36 extend downwardly from the edges of the lid member 30 on either side of the slot 32. Each of the locking pawls 36 has an inwardly directed hook tab 38 (FIG. 2) that is capable of engaging the flared section 22 of the bucket container's rim 24. A small tactile engagement tab 40 extends downwardly from each locking pawl 36, below the level of each hook tab 38.

As the lid member 30 rotates closed about hinge element 28, the locking pawls 36 abut against the rim 24 of the bucket container 12. The locking pawls 36 elastically deform around the flared section 22 of the rim 24 as the lid member 30 is pushed toward the bucket container 12. As the locking pawls 36 pass around the flared section 22 of the rim 24, the hook tabs 38 pass under the flared section 22, thereby locking the lid member 30 to the bucket container 12. The engagement of the hook tabs 38 under the flared section 22 prevents the lid member 30 from being opened by a child. In order to open the lid member 30 once it is locked closed, an adult pulls the two tactile engagement tabs 40 in a direction away from the bucket container 12, until the hook tabs 38 are clear of the flared section 22. Once the hook tabs 38 are clear of the flared section 22, the lid member 30 can be rotated about hinge element 28 into an open position. The use of two locking pawls 36 further supports the childproof design of the overall bucket assembly 10. The two locking pawls 36 are easily engaged simultaneously by an adult's hand, however, the span is too wide to be reached by the hand of a small child. Consequently, even if a child were to grasp one of the locking pawls 36 and accidentally disengage the pawl, the lid member 30 would not open.

The slot 32 is sized to accept the handle of an average mop therein. Consequently, the lid member 30 can be locked closed even when a mop is placed in the bucket container 12 and the handle of the mop extends out beyond the lid member 30. As such, a person using the present invention bucket assembly 10 can lock the mop within the bucket assembly 10 without compromising the child safety features of the design.

Figure 3:
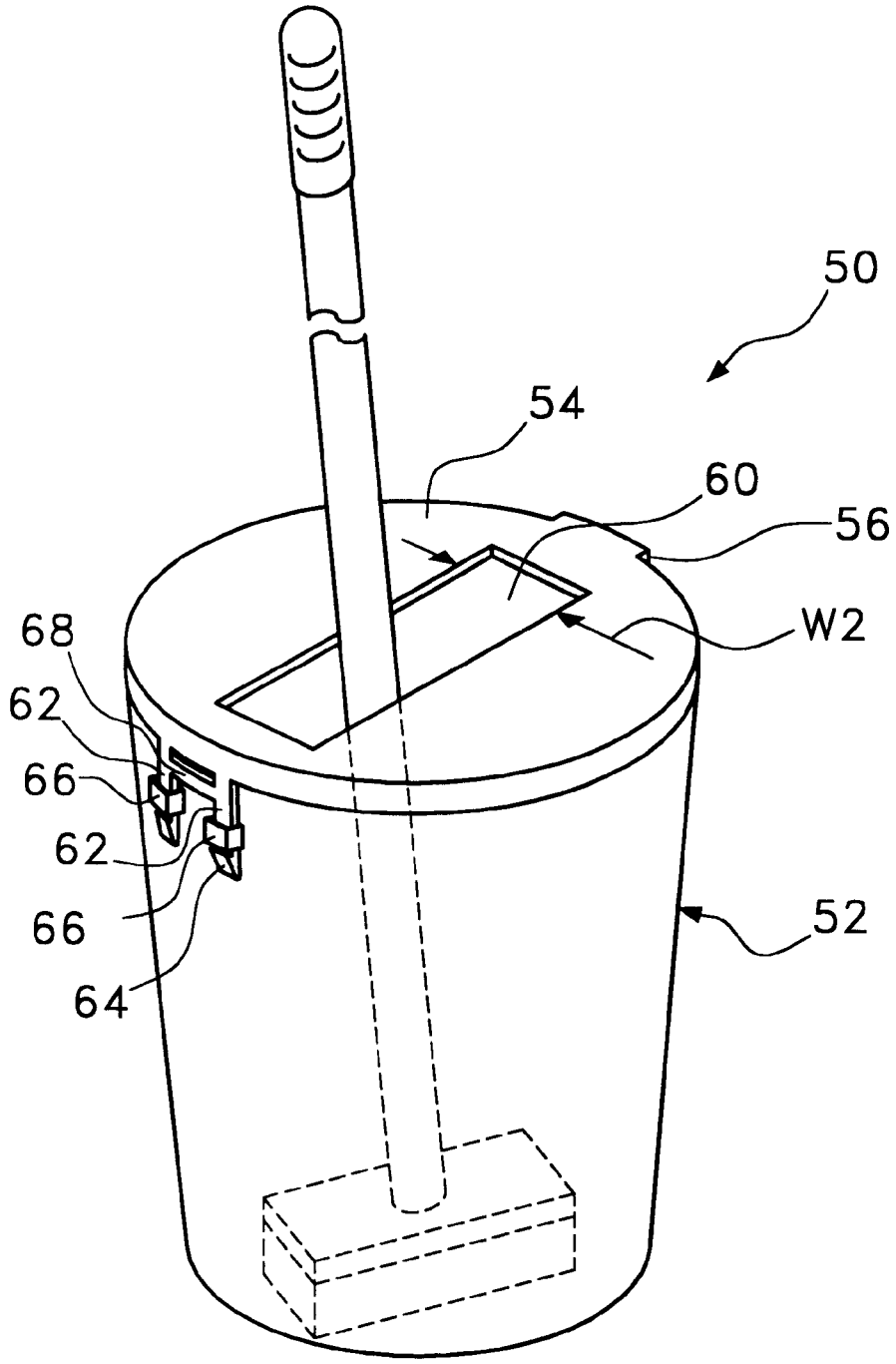
FIG. 3 is a perspective view of an alternate embodiment of the present invention bucket assembly shown in conjunction with a mop to facilitate consideration and show its intended use.
Figure 4:
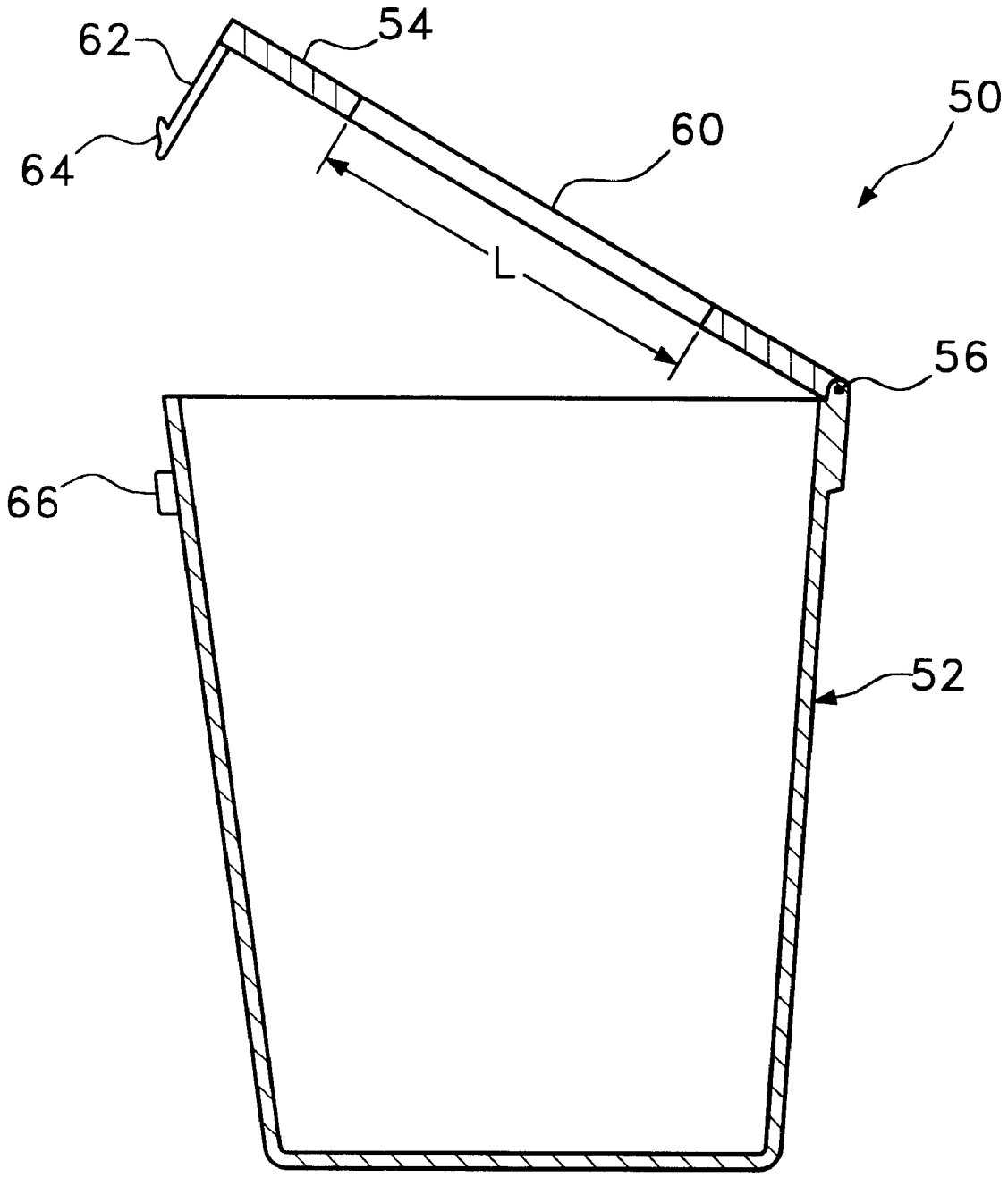
FIG. 4 is a cross-sectional view of the alternate embodiment of the present invention bucket assembly with its lid partially open to show features contained thereon.

Referring now to FIG. 3 in conjunction with FIG. 4, an alternate embodiment of the present invention bucket assembly 50 is shown. In this embodiment, the bucket container 52 and lid member 54 are both round and are joined by a hinge element 56 that is formed as an extension to both the bucket container 52 and the lid member 54.

A large rectangular aperture 60 is disposed in the center of the lid member 54. The rectangular aperture 60 has a length L (FIG. 4) of between five and ten inches and a width W2 (FIG. 3) of between three and six inches. At these dimensions, a child's head would be unable to fit into the rectangular aperture 60. However, a mop with a conventional sponge mop head or bristle brush head would be able to pass through the aperture 60. As a result, a person mopping a floor would not have to open the lid member 54 each time the mop is to be rinsed.

In the shown embodiment, the lid member 54 locks to the bucket container 52 by the use of two locking pawls 62. The two locking pawls 62 extend downwardly from the edge of the lid member 54 that is opposite the hinge element 56. Each of the locking pawls 62 terminate with an enlarged head 64. Two arches 66 are formed on the exterior of the bucket container 52. As the lid member 54 is closed onto the bucket container 52, the two locking pawls 62 pass through the two arches 66, wherein the enlarged heads 64 on the locking pawls 62 engage the arches 66 and lock the lid member 54 to the bucket container 52. A cross member 68 may be provided that connects the two locking pawls 62. In order to open the lid member 54, a person presses the cross member 68 toward the bucket container 52. The force against the cross member 68 moves the locking pawls 62, causing the locking pawls 62 to disengage the arches 66. Once the locking pawls 62 are free of the arches 66, the lid member 54 can be lifted into an open orientation. Since the opening of the lid member 54 requires that the cross member 68 be pushed inwardly and the lid member 54 be lifted simultaneously, a child is typically incapable of performing the complex manipulation. That same manipulation, however, would take very little effort from an adult.

It will understood that the specific embodiments of the invention described herein are intended to be illustrative only. Many other variations and modifications may be made thereto in accordance with the principles of the invention. For instance, it will be understood that although both embodiments of the invention shown have two locking pawls, any number of locking pawls could be used. Furthermore the bucket container and lid could have any shape and need not be the round shapes shown. All such alternate embodiments, variations and modifications should therefore be considered within the scope of the present invention, as defined by the following claims.

What is claimed is:

1. A child-proof bucket assembly for use in conjunction with a mop having a mop handle that terminates with a mop head at one end, said bucket assembly comprising:

a fluid impermeable container having an open end wherein said fluid impermeable container has a volume of at least three gallons and is capable of receiving the mop head through said open end;

a lid member sized to cover said open end of said fluid impermeable container, said lid member having a peripheral edge and defining a slot that extends inwardly from said peripheral edge, wherein said slot has a width of between one inch and two inches and a length of between two inches and five inches, and said slot is sized to enable the passage of the mop handle therethrough yet prevents the passage of the mop head therethrough, whereby said lid member can be applied to a fluid impermeable container having a mop extending therefrom without removing the mop, said lid member thereby preventing access to the mop head or contents of said fluid impermeable container.

2. The bucket assembly according to claim 1, further including a locking means for locking said lid member in a closed orientation onto said fluid impermeable container.

3. The bucket assembly according to claim 2, further including a hinge element for coupling said lid member to said fluid impermeable container.

4. The bucket assembly according to claim 3 wherein said slot is disposed on said lid member at a point opposite said hinge element.

5. The bucket assembly according to claim 2 wherein said locking means includes at least one pawl that extends from said lid member and engages said fluid impermeable container.

6. The bucket assembly according to claim 5, wherein said fluid impermeable container has a flange proximate said open end, wherein said at least one pawl engages said flange when said lid member is closed onto said fluid impermeable container.

7. The bucket assembly according to claim 5 wherein at least one arch is disposed on said fluid impermeable container, wherein said at least one pawl passes through and engages said at least one arch when said lid member is closed onto said fluid impermeable container.

8. The bucket assembly according to claim 5, wherein said at least one pawl extends downwardly from said peripheral edge of said lid member at point immediately adjacent said slot.

9. The bucket assembly according to claim 2 wherein said locking means includes a plurality of pawls that extend from said lid member and engage said fluid impermeable container.

10. The bucket assembly according to claim 9, wherein said plurality of pawls includes a first pawl that extends from said lid member on one side of said slot and a second pawl that extends from said lid member on an opposite side of said slot.

* * * * *